United States Patent [19]

Trantham et al.

[11] 4,182,416

[45] Jan. 8, 1980

[54] INDUCED OIL RECOVERY PROCESS

[75] Inventors: Joseph C. Trantham, Bartlesville, Okla.; Robert F. Meldau, Santa Maria, Calif.

[73] Assignee: Phillips Petroleum Company, Bartlesville, Okla.

[21] Appl. No.: 890,755

[22] Filed: Mar. 27, 1978

[51] Int. Cl.[2] ..... E21B 43/16; E21B 47/10

[52] U.S. Cl. ..... 166/245; 166/252; 166/263

[58] Field of Search ..... 166/263, 245, 274, 275, 166/256, 252

[56] References Cited

U.S. PATENT DOCUMENTS

| | | | |
|---|---|---|---|
| 3,113,616 | 12/1963 | Dew et al. | 166/245 |
| 3,143,169 | 8/1964 | Foulks | 166/245 |
| 3,199,587 | 8/1965 | Santourian | 166/245 |
| 3,380,524 | 4/1968 | Altamira et al. | 166/245 |
| 3,380,526 | 4/1968 | Altamira | 166/245 |
| 3,429,372 | 2/1969 | Connally, Jr. | 166/245 |
| 3,442,331 | 5/1969 | Fulton et al. | 166/263 |
| 3,478,823 | 11/1969 | Murphy | 166/274 |
| 3,525,395 | 8/1970 | Chew | 166/263 |
| 3,874,449 | 4/1975 | Hoyt et al. | 166/245 |
| 3,999,606 | 12/1976 | Bandyopadhyay et al. | 166/245 |

*Primary Examiner*—Stephen J. Novosad

[57] ABSTRACT

A fluid injection induced oil recovery process wherein fluid is injected into a formation via a plurality of fluid injection wells and is produced from the formation via a plurality of production wells, and excessive flow and channeling through a "thief" region between one injection well and one production well is controlled by successively (1) shutting in the one injection well and operating the one production well for a first period of time and (2) operating the injection well and shutting in the production well for a second period of time. This sequence is repeated as many times as desired. The sequence can be modified by adding the additional step of (3) operating both wells for a third period of time. This alternative sequence is also repeated as many times as desired.

12 Claims, 4 Drawing Figures

INDUCED OIL RECOVERY PROCESS

The present invention relates generally to the recovery of hydrocarbons from oil bearing strata. In one aspect the invention relates to a process for recovering hydrocarbons from oil bearing strata by fluid drive. In another aspect the invention relates to an improved process for recovery of hydrocarbons from oil bearing strata by injecting fluid into the strata through a plurality of injection wells and producing hydrocarbons and fluid from a plurality of production wells. Still another aspect of the present invention relates to an improved recovery process whereby channeling is reduced in a "thief" region between an injection well and a production well in a fluid drive well pattern.

Conventional five-spot, seven-spot and nine-spot well patterns or arrangements are commonly accepted in the oil industry for producing hydrocarbons by flooding or fluid drive and by in situ combustion. Studies conducted on such well patterns often reveal the existence of regions of high permeability, or "thief" regions, in the strata between an injection well and a production well. The existence of such "thief" regions adversely affects distribution of the fluid in the well pattern and can cause channeling through the "thief" region, thus resulting in inefficient sweep of injected fluid through the formation.

We have found that by alternately shutting in the injection well and shutting in the production well on opposite ends of a "thief" region or zone during a fluid drive or flooding operation, excessive flow through a "thief" region can be controlled and channeling through the region can be substantially reduced or eliminated.

The present invention contemplates an induced oil recovery process wherein a subterranean formation is penetrated by a plurality of production wells and a plurality of fluid injection wells, and wherein injection fluid is injected via the fluid injection wells and fluid is produced from the formation via the production wells, and wherein a "thief" region between a first fluid injection well and a first production well adjacent thereto results in excessive flow of injection fluid through the thief region in comparison to injection fluid flow through surrounding regions between the first injection well and other production wells adjacent thereto. Improved process includes shutting in the first production well for a first period of time while continuing to inject fluid via the first injection well and, at the end of the first period of time, shutting in the first injection well and opening the first production well for a second period of time. The process can be further characterized to include opening the first injection well and injecting fluid via the first injection well for a third period of time at the end of the second period of time.

An object of the present invention is to increase the efficiency of an induced oil recovery process.

Another object of the present invention is to provide a fluid drive induced oil recovery process wherein flow through regions of high permeability is controlled.

A further object of the present invention is to provide an improved flood or fluid drive induced oil recovery process wherein channeling through a region of high permeability between an injection well and a production well is substantially reduced or eliminated.

A still further object of the present invention is to provide an improved fluid drive or flood induced oil recovery process which is simple and economical to operate.

Other objects, aspects and advantages of the present invention will be evident from the following detailed description when read in conjunction with the accompanying drawings, in which:

FIG. 2 is a plan view of a five-spot pattern showing the fluid drive pattern of the present invention with the injection well adjacent a "thief" region shut in;

FIG. 4 is a plan view similar to FIG. 2 showing the fluid drive pattern of the present invention with the production well adjacent the "thief" region shut in.

Figure 1:
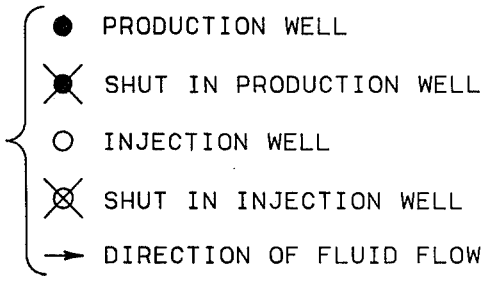
FIG. 1 illustrates the symbols used in the remaining FIGS.
Figure 2:
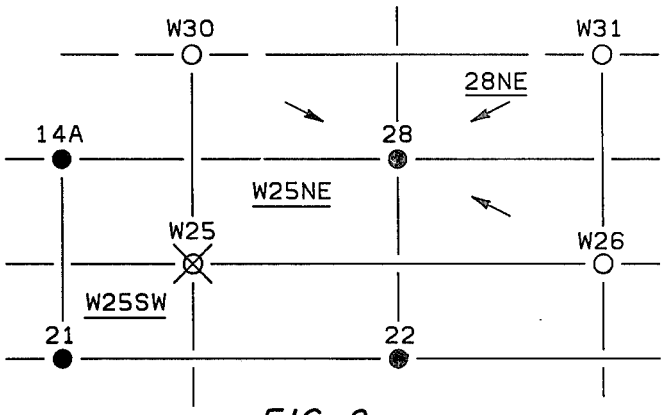
Figure 3:
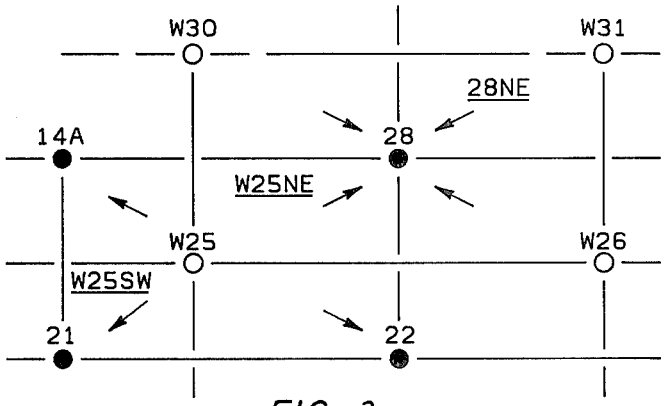
FIG. 3 is a plan view similar to FIG. 2 showing the fluid drive pattern of the present invention with the injection well and production well adjacent the "thief" region both operating.
Figure 4:
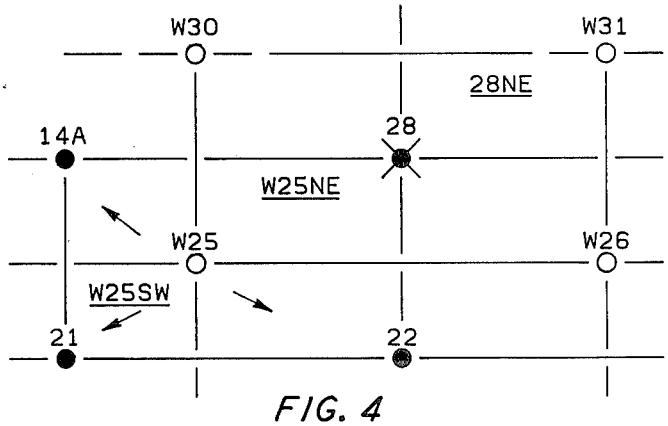

Referring now to the drawings, FIGS. 2, 3 and 4 provide schematic plan views of a portion of the well pattern locations in the North Burbank Unit Tract 97 in which surfactant/polymer pilot studies have been undertaken. The wells illustrated in FIGS. 2, 3 and 4 are arranged in a conventional five-spot pattern with the injection wells designated as W30, W31, W25 and W26, while the production wells are designated as 14A, 28, 21 and 22. The quadrant intermediate injection well W31 and production well 28 is designated as quadrant 28NE while the quadrant intermediate injection well W25 and production well 21 is designated as quadrant W25SW. The quadrant intermediate injection well W25 and production well 28 is designated as quadrant W25NE.

A study was made to determine the existence of any areas in the North Burbank Unit Tract 97 in which channeling could be a problem. Radioactive isotopes in the form of tritiated water, $Co^{57}$, $Co^{58}$ and $Co^{60}$ were injected respectively in wells W30, W25, W26 and W31 to serve as tracers of injected fluid. In the absence of channels between injection and production wells, the concentration of the four isotopes appearing in the water produced at production well 28 would have indicated about equal flow from the four offset injection wells W30, W25, W26 and W31. Analysis of the results of the injection of the radioactive isotopes showed instead that about half the fluid produced at production well 28 originated at well W25, thus pointing to a channel or high permeability zone interposed between injection well W25 and production well 28. It is readily apparent that permitting such distribution of fluid to continue during a pilot or commercial project would result in insufficient sweep of the injected chemicals in three of the four quadrants surrounding injection well W25 and three of the four quadrants surrounding production well 28. It was, therefore, essential to discourage the excessive fluid movement in the "thief" quadrant W25NE common to injection well W25 and production well 28.

To accomplish the desired reduction or elimination of excessive fluid movement in the "thief" quadrant W25NE, we found that desirable results can be obtained by alternately shutting in the injection well W25 and shutting in the production well 28 to reduce flow in the "thief" quadrant or region. Flow rates can be increased to maintain the same average rate if the well capacity permits. Our process is more clearly described by the following calculated example in relation to the wells described above and illustrated in the drawings.

CALCULATED EXAMPLE

It is desired to inject fluid into the formation at an average rate of 800 barrels per day at the injection wells and produce at the same rate at the production wells. If these rates are simply set, however, the channeling tendency would cause 400 barrels per day produced at production well 28 to come from injection well W25 and the other 400 barrels per day to come from injection wells W30, W31 and W26 (133 barrels per day from each). Similarly, half the 800 barrels per day injected into injection well W25 would go into production well 28 and the other 400 barrels per day would be divided substantially equally among the three production wells 14A, 21 and 22 (133 barrels per day to each).

By operating in the sequence shown in Table 1, the proper average amounts (200 barrels per day) can be made to flow in each quadrant. For simplicity of presentation, flow rates are given for only three quadrants (W25NE or "thief", W25SW and 28NE), but the same flow rates would apply to the other quadrants.

Table 1

| | Well Rate, BPD | | Flow in Quadrant, BPD | | |
|---|---|---|---|---|---|
| Week | W25 | 28 | Thief | W25SW | 28NE |
| 1 | 0 | 1200 | 0 | 0 | 400 |
| 2 | 1200 | 1200 | 600 | 200 | 200 |
| 3 | 1200 | 0 | 0 | 400 | 0 |
| Average | 800 | 800 | 200 | 200 | 200 |

FIRST WEEK

For the first week injection well W25 is shut in while production well 28 is operated at 1200 barrels per day. Under these conditions there will be no flow in any of the quadrants of injection well W25 as illustrated in FIG. 2. Production well 28 will produce its 1200 barrels per day from the three quadrants (400 barrels per day from each quadrant) not common to injection well W25; quadrant 28NE, for example.

SECOND WEEK

Injection well W25 and production well 28 are now each operated at 1200 barrels per day as shown in FIG. 3. Since one half of this flow will pass through the thief quadrant W25NE, the flow rate therethrough will be 600 barrels per day. Therefore, injection well W25 and production well 28 will each have the other 600 barrels per day associated with three other common quadrants (200 barrels per day for each common quadrant), W25SW and 28NE, for example.

THIRD WEEK

Production well 28 is now shut in and fluid is injected through injection well W25 at the rate of 1200 barrels per day as shown in FIG. 4. Under these conditions there will be no flow in the thief quadrants W25NE or any of the other three quadrants, to production well 28, and the fluid injected at the rate of 1200 barrels per day at injection well W25 will be divided among the three quadrants common to injection well W25 and not common to production well 28 (400 barrels per day in each); quadrant W25SW, for example.

The average rates of fluid flow for the three-week cycle shown in Table 1 are those desired. The cycle can then be repeated as often as is deemed necessary.

It will be understood by those skilled in the art that, in the field, the flow of fluids will not start and stop instantaneously, nor will the distribution of flow be known exactly. Nevertheless, through the utilization of tracer studies, as described above, flow distribution in a formation can be determined with sufficient accuracy to permit development of an operating schedule which will give marked improvement in fluid sweep. For different well patterns and different degrees of channeling than presented in the instant example, a different schedule would likely be required. However, the principle of the present invention would be the same.

From the foregoing description and example it will be readily apparent to those skilled in the art that the present invention provides a novel process for the recovery of hydrocarbons from a subterranean formation which both provides the advantages and meets the objectives recited herein. Certain modifications of the invention will become apparent to those skilled in the art and the illustrative details disclosed are not to be construed as imposing unnecessary limitations on the invention.

What is claimed is:

1. In an oil recovery process wherein a subterranean formation is penetrated by a plurality of production wells and a plurality of fluid injection wells, and wherein injection fluid is injected via said fluid injection wells and fluid is produced from the formation via the production wells, and wherein a "thief" region between a first one of said fluid injection wells and a first one of said production wells adjacent thereto results in excessive flow of injection fluid through the "thief" region in comparison to injection fluid flow through surrounding regions between the first one of said injection wells and other production wells adjacent thereto, the improvement comprising:

(a) shutting in said first one of said production wells for a first period of time while continuing to inject fluid via said plurality of injection wells; and (b) at the end of said first period of time, shutting in said first one of said injection wells and opening said first one of said production wells for a second period of time while continuing to inject fluid via others of said plurality of fluid injection wells.

2. The process as defined in claim 1 characterized further to include:

(c) at the end of said second period of time, repeating steps a and b at least one additional time.

3. A process as defined in claim 1 characterized further to include:

(c) at the end of the second period of time, opening said first one of said injection wells and injecting fluid via said plurality of injection wells for a third period of time.

4. A process as defined in claim 3 characterized further to include:

(d) at the end of said third period of time, repeating steps a through c at least one additional time.

5. A process as defined in claim 1 wherein said plurality of production wells and said plurality of fluid injection wells are arranged in a five-spot regular geometric pattern.

6. A method of recovering oil from a subterranean formation penetrated by a unit of wells comprising a plurality of injector and producer patterns of the type which includes a central well surrounded by a plurality of peripheral wells arranged in a geometric pattern with the central well at the midpoint of the geometric pattern and with each of the peripheral wells being equidistantly generally spaced from each of the adjoining peripheral wells, comprising the steps of:

(a) via said peripheral wells, injecting fluid into said formation for a first period of time to displace fluid through the formation toward said central well;

(b) producing fluids from said central well for said period of time;

(c) monitoring the fluid flow rates at said peripheral wells and at said central well;

(d) analyzing the flow rates to identify a region of higher fluid flow rate in the formation between one of said peripheral wells and said central well;

(e) shutting in said one of said peripheral wells while continuing the injecting of fluid into said formation via the remaining peripheral wells for a second period of time at the end of said first period of time;

(f) continuing to produce fluids from the formation via said central well for said second period of time;

(g) shutting in said central well for a third period of time at the end of said second period of time;

(h) continuing the injecting of fluid into the formation via the previously operating peripheral wells for said third period of time; and (i) opening said shut-in peripheral well and injecting fluid therethrough into said formation for said third period of time.

7. The method as defined in claim 6 characterized further to include the additional step of:

(j) repeating steps a through i at least one time at the end of said third period of time.

8. The method as defined in claim 6 characterized further to include the additional step of:

(j) repeating steps a through i a plurality of times at the end of said third period of time.

9. The method as defined in claim 6 wherein said injector and producer pattern is a five-spot regular geometric pattern.

10. A method of producing an oil-bearing subterranean stratum penetrated by a plurality of well bores comprising at least one production well and at least one injection well spaced therefrom with a zone of relatively high permeability located in the stratum intermediate said at least one production well and said at least one injection well, comprising the steps of:

(a) injecting a fluid in said at least one injection well for a first period of time to drive oil through said zone of relatively high permeability towards said at least one production well;

(b) producing oil from said at least one production well for said first period of time;

(c) shutting in said at least one injection well for a second period of time at the end of said first period of time;

(d) continuing to produce oil from said at least one production well for said second period of time;

(e) shutting in said at least one production well at the end of said second period of time for a third period of time; and (f) injecting fluid in said at least one injection well for said third period of time.

11. The method as defined in claim 10 characterized further to include the additional step of:

(g) repeating steps a through f at least one time at the end of said third period of time.

12. The method as defined in claim 10 characterized further to include the additional steps of:

(g) repeating steps a through f a plurality of times at the end of said third period of time.

* * * * *